US009943771B2

(12) United States Patent
Blow

(10) Patent No.: US 9,943,771 B2
(45) Date of Patent: Apr. 17, 2018

(54) METHOD, APPARATUS, AND SYSTEM FOR TOY BUILDING BLOCK(S) WITH CHAIN REACTION TRIGGER

(71) Applicant: Anthony T. Blow, San Diego, CA (US)

(72) Inventor: Anthony T. Blow, San Diego, CA (US)

( * ) Notice: Subject to any disclaimer, the term of this patent is extended or adjusted under 35 U.S.C. 154(b) by 0 days.

(21) Appl. No.: 15/120,839

(22) PCT Filed: Aug. 13, 2016

(86) PCT No.: PCT/US2016/046943

§ 371 (c)(1),
(2) Date: Aug. 23, 2016

(87) PCT Pub. No.: WO2017/040004

PCT Pub. Date: Mar. 9, 2017

(65) Prior Publication Data

US 2017/0144082 A1 May 25, 2017

Related U.S. Application Data

(60) Provisional application No. 62/213,225, filed on Sep. 2, 2015.

(51) Int. Cl.

| | |
|---|---|
| ***A63H 33/04*** | (2006.01) |
| ***A63H 33/08*** | (2006.01) |
| ***A63H 33/00*** | (2006.01) |

(52) U.S. Cl.

CPC ..... *A63H 33/042* (2013.01); *A63H 33/00* (2013.01); *A63H 33/04* (2013.01); *A63H 33/088* (2013.01)

(58) Field of Classification Search

CPC ..... A63H 33/00; A63H 33/04; A63H 33/042; A63H 33/044; A63H 33/08; A63H 33/088; A63F 9/28

See application file for complete search history.

(56) References Cited

U.S. PATENT DOCUMENTS

| | | | | |
|---|---|---|---|---|
| 1,277,702 | A * | 9/1918 | Des Combes | F41J 5/26 273/380 |
| 4,226,045 | A * | 10/1980 | Lehmann | A63H 3/00 446/101 |
| 5,380,231 | A * | 1/1995 | Brovelli | A63H 17/002 446/435 |
| 5,779,515 | A | 7/1998 | Chung | |
| 6,086,449 | A * | 7/2000 | Sharp | A63H 33/103 446/308 |

(Continued)

OTHER PUBLICATIONS

PCT ISR and WO for PCT/US2016/046943 dated Oct 26, 2026.

(Continued)

*Primary Examiner* — Gene Kim
*Assistant Examiner* — Alyssa Hylinski
(74) *Attorney, Agent, or Firm* — Mary Fales; San Diego Patent Prep & Pros, Inc.

(57) ABSTRACT

The disclosed embodiments are for a method, apparatus, and system for toy building blocks with chain reaction trigger. The blocks are configured to be coupled together in order to build structures with the blocks. The blocks house a trigger mechanism system that when triggered will then actively trigger the adjacent block's trigger mechanism system. Thus, the blocks will disconnect and/or break away from each other in a chain reaction or sequenced manner.

20 Claims, 7 Drawing Sheets

(56) References Cited

U.S. PATENT DOCUMENTS

| | | | | |
|---|---|---|---|---|
| 6,243,622 | B1 * | 6/2001 | Yim | G06F 3/016 345/12 |
| 6,450,853 | B1 | 9/2002 | Larws | |
| 6,725,128 | B2 * | 4/2004 | Hogg | G06N 3/008 318/560 |
| 6,893,316 | B2 * | 5/2005 | Maxwell | A63H 33/042 446/103 |
| 7,575,496 | B2 * | 8/2009 | Lau | A63H 3/20 446/308 |
| 8,742,814 | B2 * | 6/2014 | Binder | A63F 9/24 327/261 |
| 8,756,894 | B2 | 6/2014 | Swartz | |
| 8,920,207 | B2 * | 12/2014 | Hageman | A63H 33/086 446/102 |
| 2003/0060117 | A1 | 3/2003 | Racine | |
| 2008/0166926 | A1 | 7/2008 | Seymour | |
| 2009/0215357 | A1 | 8/2009 | Seligman | |
| 2010/0210172 | A1 | 8/2010 | Worthington | |
| 2011/0151743 | A1 * | 6/2011 | Munch | A63H 33/042 446/91 |
| 2012/0309257 | A1 | 12/2012 | Mcdonald | |
| 2013/0312357 | A1 | 11/2013 | Lin | |
| 2013/0330998 | A1 | 12/2013 | Fox | |
| 2014/0097262 | A1 | 4/2014 | Ostendorff | |
| 2014/0273707 | A1 * | 9/2014 | Becker | A63H 33/00 446/4 |
| 2015/0093964 | A1 | 4/2015 | Schmid | |
| 2016/0115982 | A1 | 4/2016 | Lin | |

OTHER PUBLICATIONS

"Interlocking Boulding Blocks offer "limitless possibilities" for construction," www.dezeen.com/2016/05/14/interlocking-boulding-blocks-mark-boulding-construction-toy/ May 14, 2016 (last accessed Aug. 23, 2016).

"Brixo building blocks bring your design to life with electricity" www.getbrixo.com (last accessed Aug. 23, 2016).

* cited by examiner

METHOD, APPARATUS, AND SYSTEM FOR TOY BUILDING BLOCK(S) WITH CHAIN REACTION TRIGGER

I. CLAIM TO PRIORITY UNDER 35 U.S.C. § 119

The present application for patent claims the benefit of U.S. Provisional Application No. 62/213,225 filed on Sep. 2, 2015, entitled, "BREAK AWAY TOY BUILDING BLOCKS WITH CASCADING TRIGGER," of which is expressly incorporated herein by reference in its entirety.

II. FIELD

The disclosed embodiments relate to toy building block(s).

III. BACKGROUND

People of all ages enjoy toys. Toy building blocks can be especially useful to a child's development and can provide hours of entertainment. Current building blocks connect to each other, but do not have a creative or easy way to disengage from each other. For example, Lego® toy blocks connect together to form structures, but then the user has to take the blocks apart piece by piece. The mechanical connection for toy blocks may be simple (friction based coupling, magnets, loose stacking, etc.). Some toys like Zoobles (tiny balls that have pop open features when dropped) have a trigger type interaction, but the pieces that move when triggered are few and are permanently attached to the toy. For these toys, the trigger action simply allows a couple of parts to release and pivot in place. Thus, there is a need in the art for toy building block(s) with chain reaction trigger.

IV. SUMMARY

Disclosed are embodiments for a method, apparatus, and system for toy building block(s) with chain reaction trigger. In an embodiment, a toy building block with chain reaction trigger, is described comprising: a body comprising a chamber module; a tension module housed in the chamber module, the chamber module configured to receive a second block's hammer module; a hammer module housed in the chamber module and configured to be movable upon an axis of the chamber module, the released hammer module configured to trigger a second toy building block; a latching module housed in the chamber module, the latching module configured to hold the hammer module under tension; and a releasing module, the releasing module configured to release the hammer module.

In yet another embodiment, a collapsible toy structure, is described comprising: at least two toy building blocks, the blocks comprising chain reaction triggers; and a triggering system.

V. BRIEF DESCRIPTION OF THE DRAWINGS

The following embodiments may be better understood by referring to the following figures. The figures are presented for illustration purposes only, and may not be drawn to scale or show every feature, orientation, or detail of the embodiments. They are simplified to help one of skill in the art understand the embodiments readily, and should not be considered limiting.

FIG. 1. illustrates a simplified example of a building structure made with the blocks in an embodiment(s).

DETAILED DESCRIPTION

Each of the additional features and teachings disclosed below can be utilized separately or in conjunction with other features and teachings to provide a method, apparatus, and system for toy building block(s) with chain reaction trigger. Representative examples of the following embodiments will now be described in further detail with reference to the attached drawings. This detailed description is merely intended to teach a person of skill in the art details for practicing the preferred aspects of the teachings and is not intended to limit the scope of the embodiments.

Disclosed in the embodiments, is a toy system that comprises multiple blocks that removably attach to one another to form a structure. A structure may be any combination of blocks that comprises at least two blocks. The blocks comprise an active action mechanism that when triggered causes all the blocks attached to the structure to release from each other in a sequenced ("chain reaction" or "cascading") effect. Basically, one block's trigger, actively triggers the next block's trigger and so on until all of the blocks are detached from each other. "Block(s)," hereinafter, are the toy building block(s) with chain reaction trigger unless specifically stated otherwise.

Figure 1:
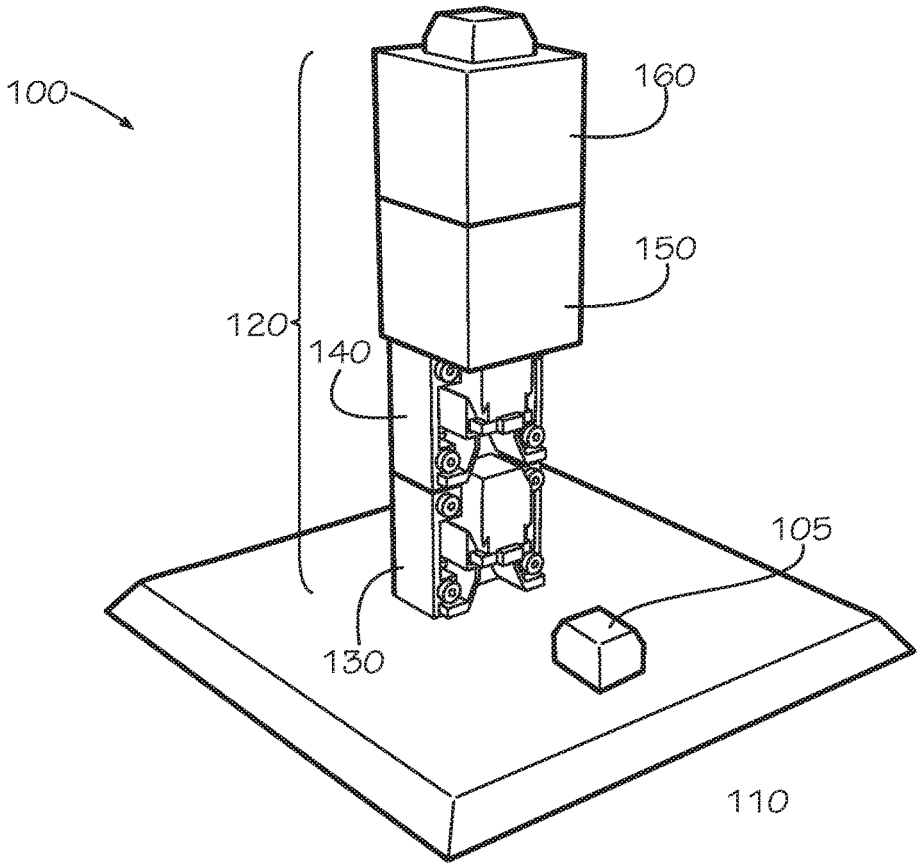

FIG. 1 illustrates a simplified example of a building structure 100 made with the blocks. In an embodiment, the structure 100 may optionally be mounted on a base 110. The structure 100 may be made up of the blocks 120. In an embodiment, the base 110 may have a built in trigger mechanism 105. When the trigger mechanism 105 may be engaged, the trigger mechanism may release a first block 130. Blocks 130 and 140 are shown in a cutaway view for illustrative purposes only. The first block's 130 release automatically and actively triggers the next block's release 140. Which in turn, automatically triggers the next block's release 150. Which in turn, automatically triggers the last block's release 160. Thus, the blocks disengage in a sequenced cascading manner. An example of a possible result is shown in FIG. 2.

Figure 2:
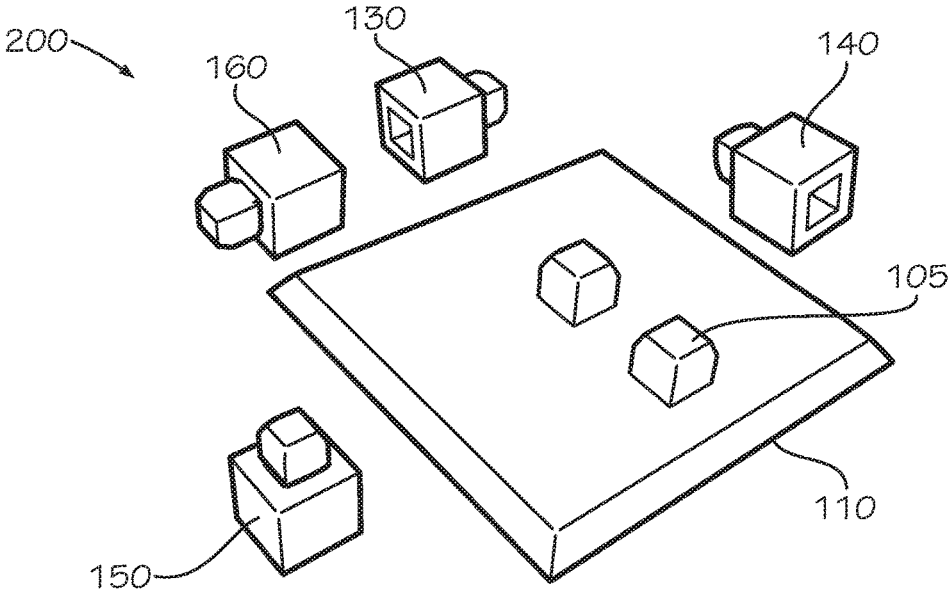
FIG. 2 illustrates an example of how the blocks of FIG. 1 may disengage in an embodiment(s).

FIG. 2 illustrates an example of how the blocks of FIG. 1 may disengage 200 in an embodiment(s). Blocks 130-160 have all disconnected from each other in a cascading manner after being triggered 105. The time it requires to disengage all the blocks may be relatively quick as each block trigger may release and trigger within 100 milliseconds to 250 milliseconds.

In embodiments, the blocks may comprise any shape or size desired to create the overall effect (or structure). In an embodiment, the blocks are sized as small as practical to house the block modules shown in FIG. 4. In another embodiment, the blocks may be sized between half an inch to two feet in diameter. In an embodiment, the blocks may be between half an inch to two feet in height. The blocks may be shaped rectangle, square, triangular, rounded, curved, odd shaped, unsymmetrical about a center axis, symmetrical about a center axis, spherical, conical, hexigonical, any unique shape configured for an overall structure effect, or any combinations thereof. The blocks may be custom made shapes to be used in a specific toy configuration. For example, in an embodiment, the blocks may be wheels, doors, and "car parts," that fall off a toy vehicle. In another embodiment, the blocks may comprise a building and a demolition wrecking ball triggers their release. In another embodiment, the blocks may be sized for safety reasons such that the size of a hammer releasing may not hurt an eye, and/or the extent that the hammer protrudes may be a distance such that it may not injury an eye. In conjunction, a trigger mechanism may be designed such that the blocks may not trigger and release unless it may be away from an eye or in a safe position. In an embodiment, the blocks, may be designed to be sized in units of blocks. For example, one unit may be a single square block. A block the size of two units may be the size of two square blocks together. Multiple variations of unit sizes (e.g. 4×4) are well known in the art and envisioned within the scope of the embodiments. The block's shape may be formed to create an overall predetermined structure. For example, a Star Wars® Death Star®.

Figure 3:
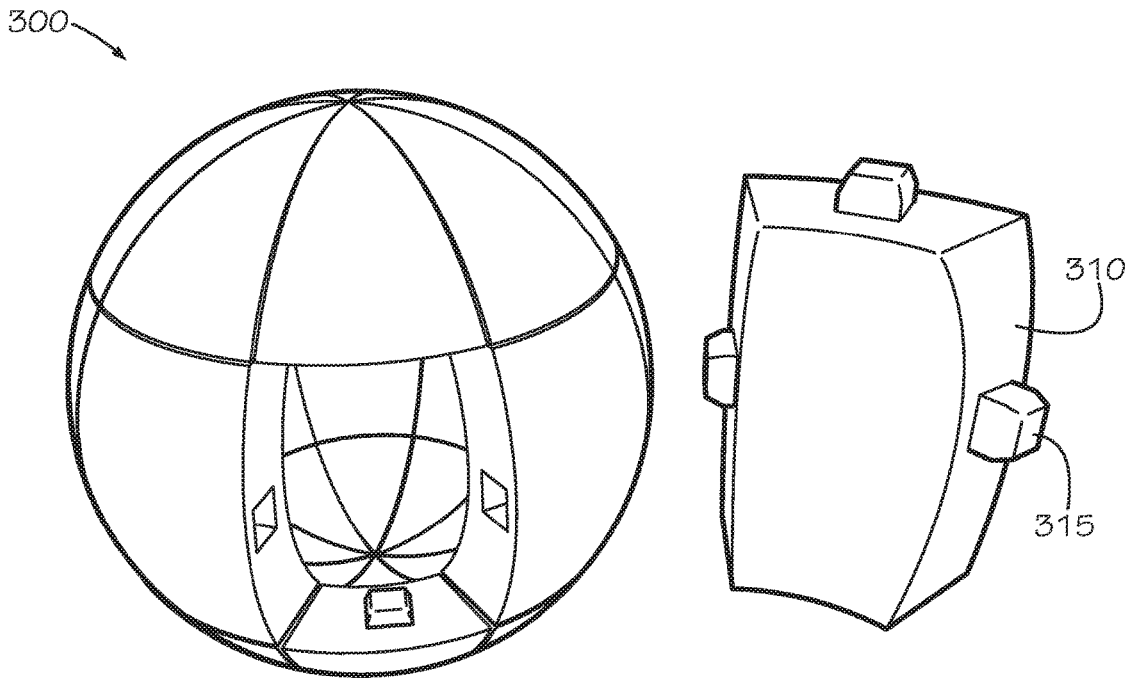
FIG. 3 illustrates a simplified view of a predetermined structure in an embodiment(s).

FIG. 3 illustrates a simplified view of a predetermined structure 300 in an embodiment(s). For example, the rounded structure 300 may represent a hollow egg. The "egg" 300 may be made up of many curved shaped blocks 310 that created the overall oval egg shape. In an embodiment, the blocks 310 may be shaped and sized differently from each other in order to create the overall egg shape. The triggering mechanisms 315 shown partly in blocks 310 may comprise multiple trigger and release mechanisms per block, so that different sides of the blocks 310 may be attached and to other blocks to form many possible 3-D structures that trigger release from one or more sides. In an embodiment, when the trigger may be engaged, the whole egg structure may disconnect all the blocks 310 in the cascading manner described. In an embodiment, a toy dinosaur (or any animal) may be inside the egg when the egg hatches (when the blocks are triggered to release).

In an embodiment, the blocks may be made of molded plastic(s), plastic(s), metal(s), wood(s), composite, thermoplastic, elastomer, polymer, etc, or various combinations of these, or any other suitable material(s). The blocks may be textured, smooth, and/or colored as desired. They may be assembled, mold injected, 3-D printed or any combinations thereof. The blocks may comprise a surface ornamental design. The block's hammer may comprise an ornamental design.

In an embodiment, the trigger mechanism may be a special "master block" that may be used to trigger the other blocks in a structure. In another embodiment, the trigger mechanism may be a button or mechanism attached to the surface of the "master block." In this example, a person could create the structure, then find the master block and push on its "button" to trigger release. In an embodiment, the trigger mechanism may be a keyed master block that may be pushed into another block to engage the cascading release. In an embodiment, the trigger mechanism may be purely mechanical in composition. In another embodiment, the trigger mechanism may be electromechanical in composition. The trigger mechanism may utilize wireless signals to initiate and engage release. For example, the trigger mechanism may comprise a separate device from the structure that comprises a transceiver that uses low power ranging communication protocols, like Bluetooth®, to send and receive singles to a master block that comprises a corresponding transceiver. Or another example, the trigger release may be built into a radio remote controller and receiver.

In an embodiment, the trigger mechanism may be a system. For example, the trigger may comprise a release module in the block, a mechanism that engages the release module, and a user interface. A separate device may have a User Interface (UI) that allows a person to press a touch screen or press button(s) that informs the transmitter to send a "release" signal to the master block. In an embodiment, an application may run on a wireless portable device that controls the trigger remotely. For example, an application on an iPad®. The trigger may have a timed and/or timer aspect. For example, a user can set a timer and the trigger will engage when the timer may be counted down. The master block's receiver may receive the "release" message which in turn triggers an electrical mechanical release. In an embodiment, the trigger mechanism may resemble an old fashion TNT detonator. In an embodiment, the trigger may be initiated by a verbal command from the user via voice recognition applications.

In an embodiment, the trigger system may utilize wireless signals, pneumatics, hydraulics, light detectors, radio frequency, magnetic, switch, pull string, wire cable, button, capacitor sensor, sensors, sound, or various combinations of these, or any other equivalent mediums.

Figure 4:
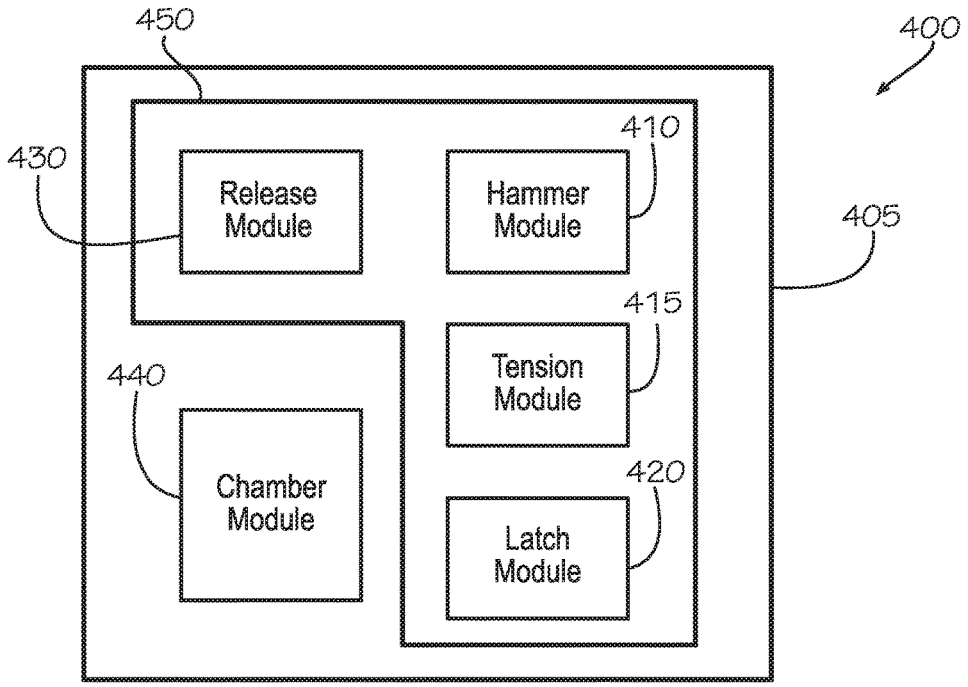
FIG. 4 illustrates block modules in an embodiment(s).

FIG. 4 illustrates block modules 400 in an embodiment(s). The block body 405 may comprise a hammer (actuator, piston) module 410. The hammer may be moveable up or down, side to side, in a vertical or horizontal direction, or a combination thereof, inside a chamber module 440. Block 400 may comprise a tension module 415. In an embodiment, the tension module comprises a spring. Block 400 may comprise a latch module 420 and a release module 430. In an embodiment the latch 420 and release 430 modules are combined into a single unit, module, or system. In another embodiment, the latch 420 and release 430 modules are separate interconnecting parts or units. Action mechanism 450 collectively may comprise the hammer module 410, the release 430 and latching 420 modules, and the tension module 415. The various modules may be implemented in more than one way.

Figure 5:
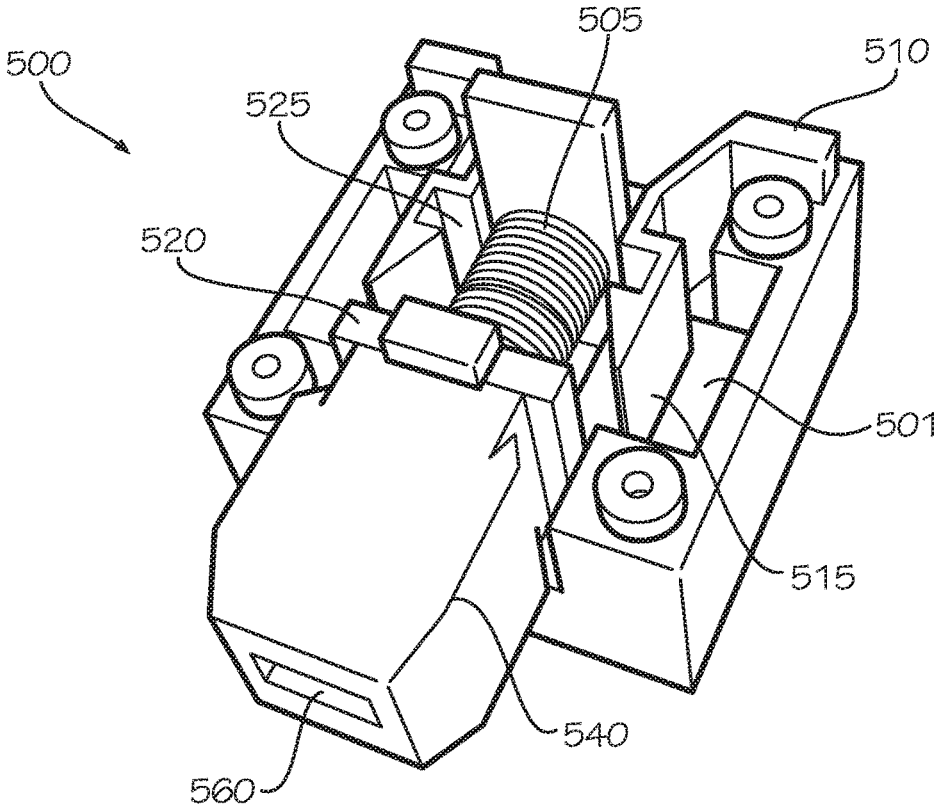
FIG. 5 illustrates a cut away view of a block in a non-compressed (unlatched) state in an embodiment(s).
Figure 6A:
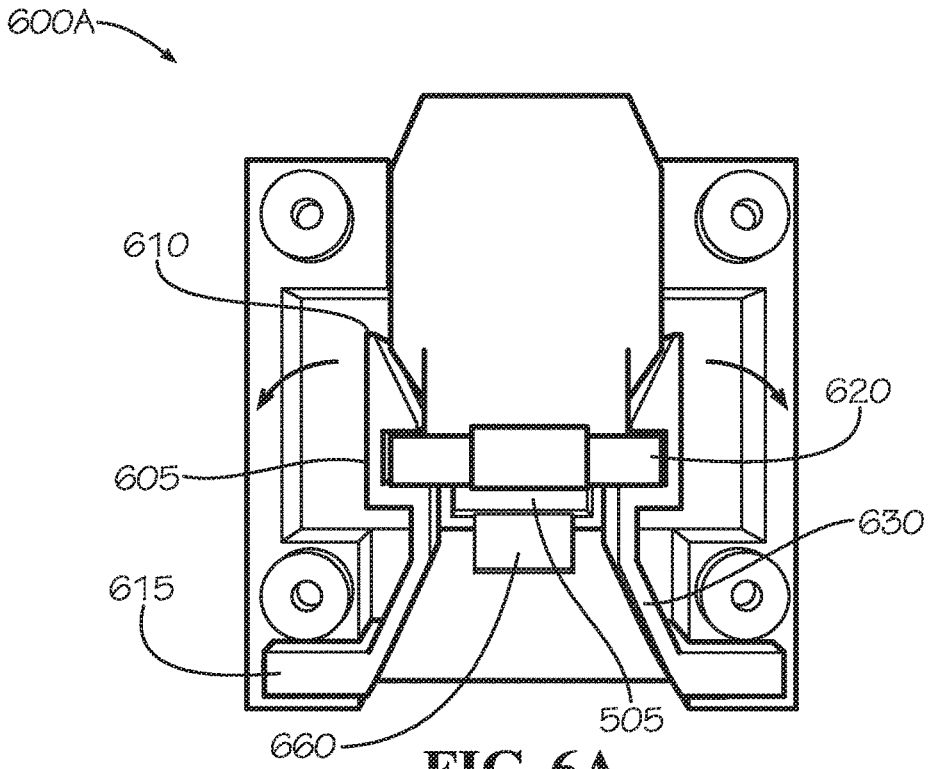
FIG. 6A illustrates another cut away view of a block in a compressed (latched) state in an embodiment(s).

FIG. 5 illustrates a cut away view of a block in a non-compressed (unlatched) state in an embodiment(s). In an embodiment, block 500 which may be considered to be an embodiment of block 400, may comprise a chamber 501 that houses a movable hammer 540, a tension mechanism (like a spring, or opposing magnets) 505, and flexible clips (or latches, clasps) 510. The movable hammer 540 may comprise a chamber or recess located at the bottom of the hammer that may receive the tension mechanism (like a spring) 505 when it may be in a compressed position (potential energy position, kinetic energy, stored energy position), as shown in FIG. 6A. The tension mechanism 505 may float in the recess or be physical attached to the hammer, it may be constructed (e.g. 3-D printed, molded, assembled) as part of the hammer, may float in the block chamber, or be physical attached within the block chamber, or part of the block chamber, or any combinations thereof.

In an embodiment, the blocks may be stacked onto each other loosely. In another embodiment, the hammer mechanism 540 may comprise an additional holding/mating mechanism 560 that when pushed into another block 660 temporarily secures the two blocks together. For example, with a friction coupling. In an embodiment, this additional holding mechanism 560, may release in conjunction with the trigger release. The holding mechanism may be thought of as a block stabilizer. In another embodiment, the block's top surface may comprise mating holders to help temporarily secure the blocks more than loosely resting on each other. For example, friction coupling may be used. The additional holders may be notches and mating recesses. In an embodiment, the flexible spring clips 510 housed in chamber 501 comprise triangular shaped arms 515 with female recesses (members) 525 that mate with male tabs (members) 520 on the hammer. The hammer 540 may be pushed down by external mechanical force using a tool, or the fingers, or another block, into the chamber 501 compressing the tension mechanism 505.

FIG. 6A illustrates another cut away view of a block 600A in a compressed (latched) state in an embodiment(s). In an embodiment, the flexible spring clips 615 housed in the chamber 501 comprise triangular shaped arms 610 with female recesses (members) 605 that mate with male tabs (members) 620 on the hammer. When the hammer may be pushed down into the chamber 501, by the force of a user's fingers, or by a block being pushed onto it, the hammer 540 may be pushed down into the chamber 501 compressing the tension mechanism 505. In an embodiment, there may be one or more male tabs corresponding with one or more female recesses. In an embodiment, one interconnecting male tab and female recess may be in the chamber. As the hammer 540 slides into the chamber 501, the ramped sides 610 of the clips push outward allowing the hammer 540 to recede further into the chamber 501. The hammer's male tabs 520 eventually push past the clip ramped surface 610 and slide to a stopping position into the female recesses 605. When the tension mechanism 505 may be compressed the female recesses on the clips hold the male tabs of the hammer 540 and prevent the hammer from releasing. In other words the female members and male members (portions) temporarily lock together. When a trigger mechanism may be engaged as described in any of the various ways, a physical force may be asserted into the bottom of the block into the chamber 501. This physical force pushes the clip arms about midway 630 on the arms pushing them outwardly. The physical force may be understood to be enough to move the clips for them to release. In an embodiment, the force asserted with the hammer releasing may be designed to have the blocks disengage in a certain desired manner. For example, the distance they may fall from each other or how fast they disengage. When the clip arms are pushed outwardly the male tabs are released from the female recesses and the stored force of the compressed tension mechanism 505 may be released pushing the hammer 540 upwards from the inside of the chamber 501 into the next block's chamber. Thus, the hammer 540 when released actively triggers the next block's clip arms to release, creating the cascading (chain reaction) effect described.

Figure 6B:
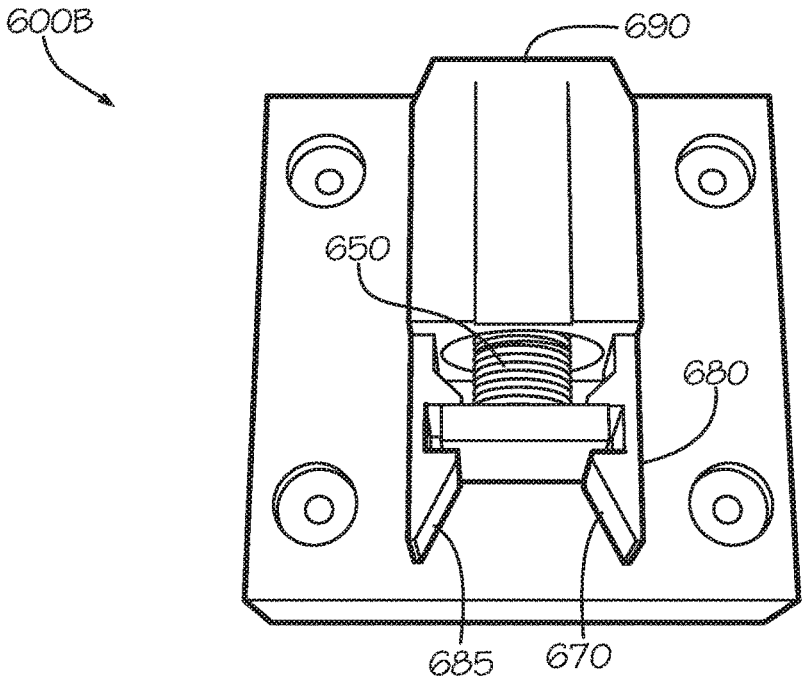
FIG. 6B illustrates another useful cut away view of a block in a compressed (latched) state in an embodiment(s).

FIG. 6B illustrates another useful cut away view of a block 600B in a compressed (latched) state in an embodiment(s). In another embodiment, the hammer 690 has the female latching mechanism build into it as shown in FIG. 6B. In an embodiment, flexible spring clips 680 comprise triangular shaped arms 685 with female recesses (members) that may be integrated into the hammer 690. The integrated hammer spring clips 680 that comprise one or more female recesses, may mate with one or more male tabs (members) 670, which also provide a compression backstop. The male tab 670 may be attached to the block chamber. In an embodiment, the hammer 690 may be pushed back against a tension spring 650 into the locking position. The hammer 690 may be locked when its clips female recesses (members) receive the male tab(s) 670. When another block's trigger (or a trigger from a base), may be engaged, it releases a hammer that pushes up to spread open the flexible clips 680. This releases the hammer 690 (into an unlocked position). This in turn causes the spring 650 to push the hammer 690 up. In turn, hammer 690 then pushes up into the next block's chamber in a cascading chain reaction.

In an embodiment, the compression forces needed to propel the hammer are provided by opposing magnets. In an embodiment, the force required in a tension mechanism to release the adjoining blocks may be between 0.4-1.5 Newtons/mm. The various hammer, latching, and release mechanisms described within the chamber may comprise multiple interacting parts or units such that for example, one trigger engages more than one hammer to release. For example, block 310 has more than one hammer mechanism 315. In an embodiment, the hammer may extend out the upper, bottom, and/or side, or any combinations thereof, of the blocks. In an embodiment, the horizontal and/or vertical action mechanisms fit within the chamber as to not interfere with each other's motion of parts. In another embodiment, a block with more than one action mechanisms may have an entering hammer trigger more than one hammer output. Thus, a single hammer coming in from the bottom of the block may trigger more than one hammer in either the vertical or horizontal directions.

Figure 7A:
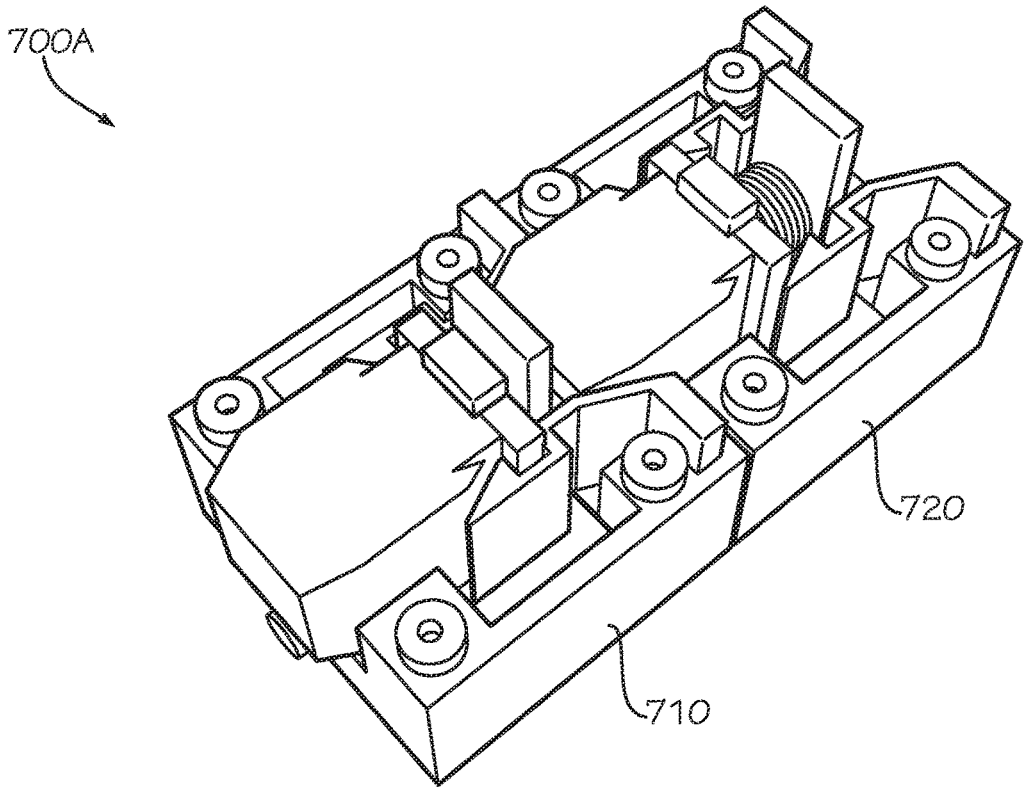
FIG. 7A illustrates a cut away view of two blocks joined together in an embodiment(s).
Figure 7B:
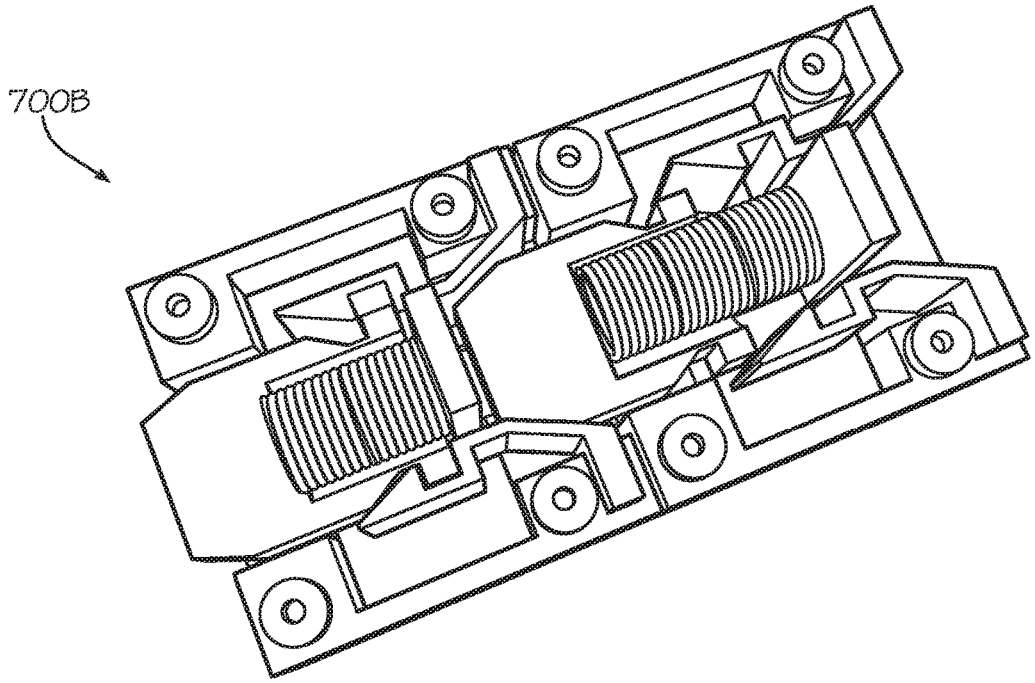
FIG. 7B illustrates another cut away view of two blocks joined together in an embodiment(s).
Figure 7C:
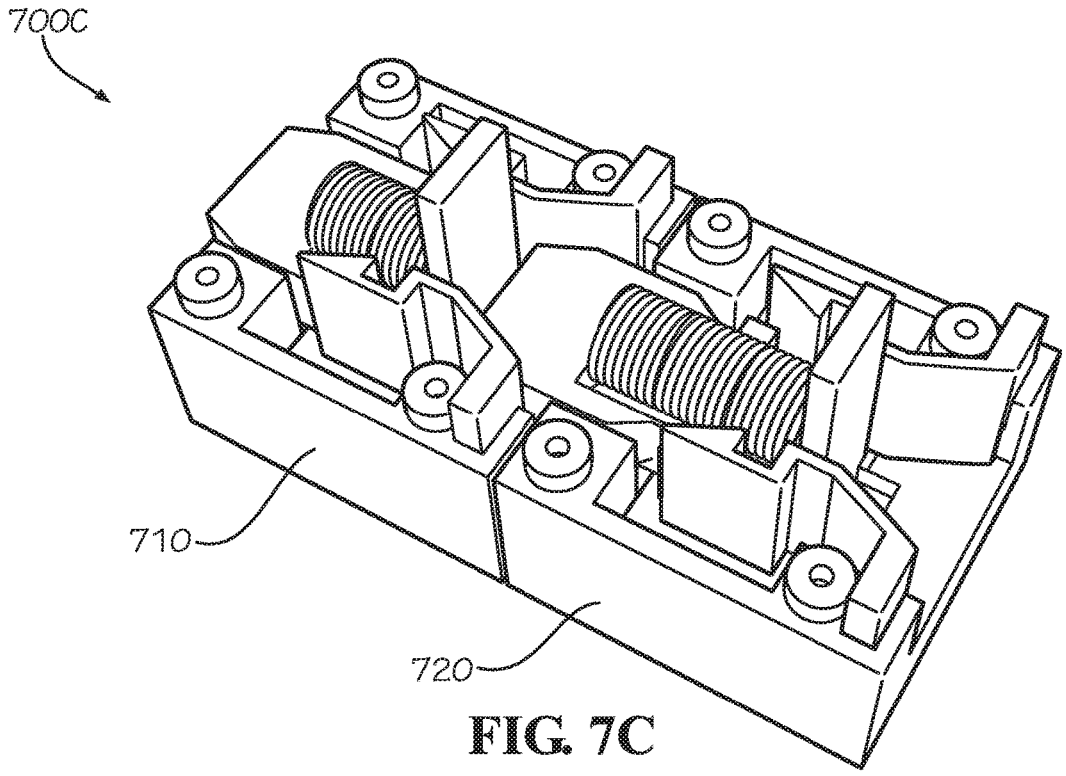
FIG. 7C illustrates yet another cut away view of two blocks joined together in an embodiment(s).

FIG. 7A-7 illustrates useful cut away views of two blocks joined together 700A-700C in an embodiment(s). The views help illustrate the block modules with different views of cutaway. Blocks 700A-700C show two blocks 710 and 720 joined. Block 710 is shown in a latched position just before releasing and block 720 is shown in a releasing position just before spreading apart the arms in block 710.

Figure 8:
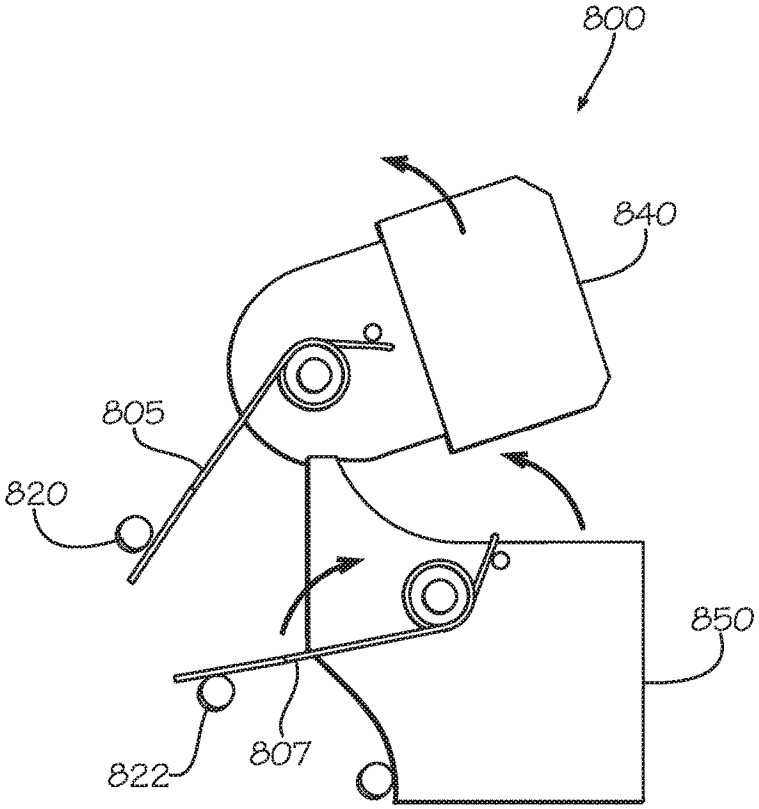
FIG. 8 illustrates another action mechanism of a block in an embodiment(s).

FIG. 8 illustrates another action mechanism of a block 800 in an embodiment(s). FIG. 8 helps demonstrate how the hammer latching and release motions may be rotational rather than primarily vertical or horizontal in nature. Hammer 840 is shown in a latched position. Trigger reset spring 805 holds the hammer 840 under tension in the latched position. A spring stop 820 for trigger reset spring 805 is shown, and may be positioned on the hammer or in the block chamber. Latching and release mechanism 850 prevents the hammer 840 from rotating upward in its latched position. Trigger reset spring 807 and spring stop 822 holds the latching and release mechanism 850 in place until a force may be applied under 850 causing 850 to rotate upwards to the left thus releasing the hammer 840 upwards to the left. Spring stop 822 may be positioned on the latching and release mechanism 850 or in the block chamber.

Figure 9:
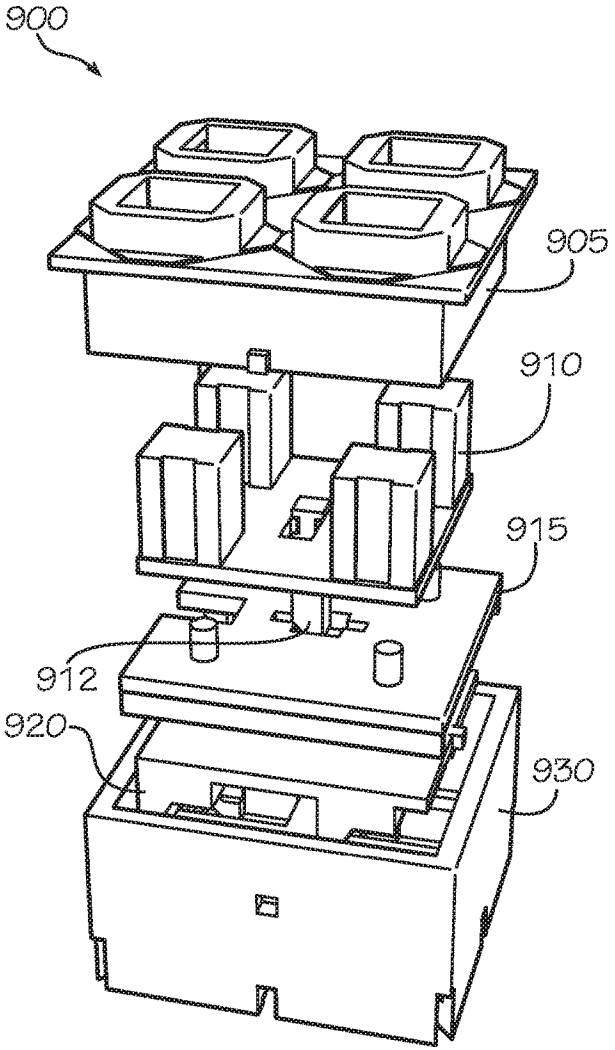
FIG. 9 illustrates an exploded view of a 2×2 block 900 components in an embodiment(s).

FIG. 9 illustrates an exploded view of a 2×2 block 900 components in an embodiment(s). In an embodiment, a 2×2 hammer 910 may move vertically up through the openings in section 905 when released. The hammer may be triggered by a single block's hammer, or by another 2×2 block's hammer. Hammer 910 may have a movable-attached hammer trigger latch 912. Hammer trigger latch 912 may pass down vertically through an opening of a spring plate 915. Trigger plate 920 may move aside horizontally caused by a ramped head on the end of hammer trigger latch 912. Trigger plate 920 may continue moving until the hammer 910 comes to a stopping point against the spring plate 915. When the hammer 910 and hammer trigger latch 912 come to a stop, a female recess within the trigger latch 912 aligns with a male edge formed by the cross section of an opening in the trigger plate 920. The force of a reset spring forces male edge of the trigger plate 920, into the female recess notch of the hammer trigger latch 912. When the tension mechanism between the spring plate 915 and the hammer 910 may be compressed and the hammer trigger latch female recess holds the male tab of the trigger plate 920, the hammer 915 and hammer trigger assembly are prevented from releasing. In other words the female members and male members (portions) temporarily lock together. When the hammer and hammer trigger assembly are engaged to the trigger, any compression force between the hammer 910 and spring plate 915 may be constrained in a tension between them. When a trigger mechanism may be engaged physically into one or more mating cells at the bottom of the block into the chamber 930, the trigger plate 920 may be moved horizontally until it may be disengaged from the hammer trigger lock and the hammer 910 may be released.

Figure 10:
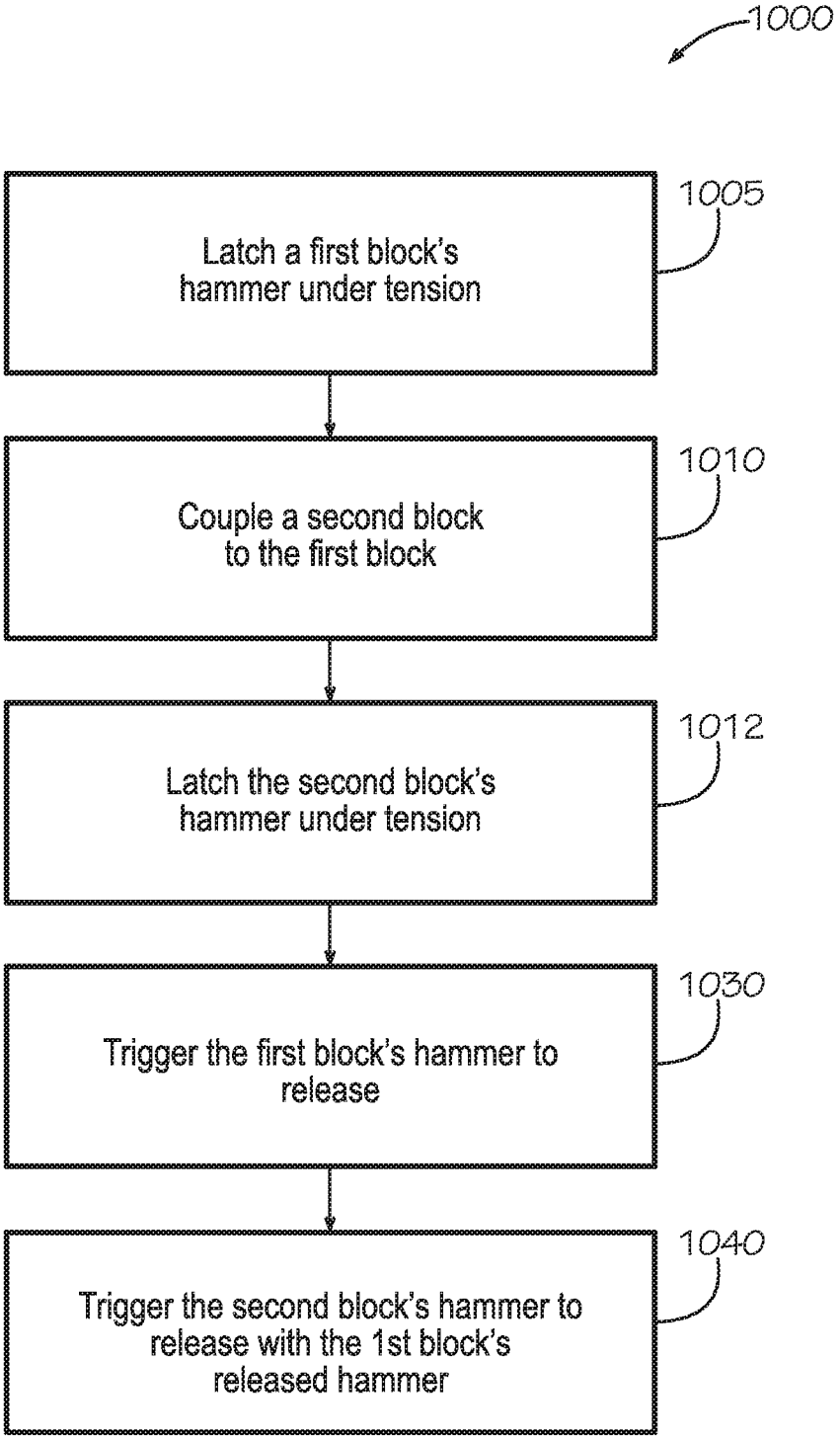
FIG. 10 illustrates a method of triggering blocks of a toy structure utilizing chain reaction blocks in an embodiment(s).

FIG. 10 illustrates a method 1000 of triggering blocks of a toy structure utilizing chain reaction blocks in an embodiment(s). At step 1005, latching a hammer mechanism in a first block under tension. Then, in step 1010, coupling a second block to the first block. At step 1012, (which is an optional step used with coupling additional blocks) latching the second block's hammer under tension. At step 1030, triggering the hammer mechanism in the first block to release. And if the second block's hammer were latched in step 1012, then in step 1040, triggering the first block's hammer release would trigger the second block's hammer to release. The method 1000 describes how coupling and latching blocks that make up a toy structure would allow the blocks to be coupled together and then released in a cascading manner. In an embodiment, the triggering comprises electromechanical interactions, mechanical interactions, or any combinations thereof as described.

In other embodiments, the processing modules may be implemented using a shared processing device, individual processing devices, or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on operational instructions.

The described embodiments or any part(s) or function(s) thereof, may be implemented using hardware, software, or a combination thereof, and may be implemented in one or more computer systems or other processing systems. A computer system for performing the operations of the described embodiments and capable of carrying out the functionality described herein can include one or more processors connected to a communications infrastructure (e.g., a communications bus, a cross-over bar, or a network). Various software embodiments are described in terms of such an exemplary computer system. After reading this description, it will become apparent to a person skilled in the relevant art(s) how to implement the embodiments using other computer systems and/or architectures.

The foregoing description of the preferred embodiments has been presented for purposes of illustration and description. It is not intended to be exhaustive or to limit the embodiments to the precise form or to exemplary embodiments disclosed. Obviously, many modifications and variations will be apparent to practitioners skilled in this art. Similarly, any process steps described might be interchangeable with other steps in order to achieve the same result. The embodiments were chosen and described in order to best explain the principles of the embodiments and its best mode practical application, thereby to enable others skilled in the art to understand the various embodiments and with various modifications as are suited to the particular use or implementation contemplated. It is intended that the scope of the embodiments be defined by the claims appended hereto and their equivalents. Reference to an element in the singular is not intended to mean "one and only one" unless explicitly so stated, but rather means "one or more." Moreover, no element, component, nor method step in the described disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

In addition, the conjunction "and" when used in the claims is meant to be interpreted as follows: "X, Y and Z" means it can be either X, Y or Z individually, or it can be both X and Y together, both X and Z together, both Y and Z together, or all of X, Y, and Z together.

It should be understood that the figures illustrated in the attachments, which highlight the functionality and advantages of the described embodiments, are presented for example purposes only. The architecture of the described embodiments are sufficiently flexible and configurable, such that it may be utilized (and navigated) in ways other than that shown in the accompanying figures.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the described embodiments in any way. It is also to be understood that the steps and processes recited in the claims need not be performed in the order presented.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function. A process or method may be implemented with a processor, or similar device, or any combination of hardware and software.

Moreover, a storage medium may represent one or more devices for storing data, including read-only memory (ROM), random access memory (RAM), magnetic disk storage mediums, optical storage mediums, flash memory devices and/or other machine-readable mediums, processor-readable mediums, and/or computer-readable mediums for storing information. The terms "machine-readable medium", "computer-readable medium", and/or "processor-readable medium" may include, but are not limited to non-transitory mediums such as portable or fixed storage devices, optical storage devices, and various other mediums capable of storing, containing or carrying instruction(s) and/or data. Thus, the various methods described herein may be fully or partially implemented by instructions and/or data that may be stored in a "machine-readable medium", "computer-readable medium", and/or "processor-readable medium" and executed by one or more processors, machines and/or devices. Moreover, a micro processor, or similar device may have internal or external memory associated with it.

The various features of the embodiments described herein can be implemented in different systems without departing from the embodiments. It should be noted that the foregoing embodiments are merely examples and are not to be construed as limiting the embodiments. The description of the embodiments is intended to be illustrative, and not to limit the scope of the claims. As such, the described teachings can be readily applied to other types of apparatuses and many alternatives, modifications, and variations will be apparent to those skilled in the art.

What is claimed is:

1. A toy building block with chain reaction trigger, comprising:

a body comprising a chamber module;

a tension module housed in the chamber module, the chamber module configured to receive a second toy building block's hammer module;

a hammer module housed in the chamber module and configured to be movable upon an axis of the chamber module, the hammer module configured to trigger the second toy building block;

a latching module housed in the chamber module, the latching module configured to hold the hammer module under tension, the hammer module comprising at least one male tab the chamber module comprising and at least one clip housed in the chamber module, the clip comprising a flexible spring biased arm comprising a female recess, the at least one male tab and the female recess are configured to mate to latch the hammer module under tension and configured to un-mate to release the hammer module; and a releasing module, the releasing module configured to release the hammer module.

2. The toy building block of claim 1, wherein the toy building block comprises more than one hammer module.

3. The toy building block of claim 1, wherein the latching module and the releasing module comprise a single unit.

4. The toy building block of claim 1, wherein the latching module and the releasing module are separate units.

5. The toy building block of claim 1, wherein the axis is vertical, horizontal or both.

6. The toy building block of claim 1, wherein the releasing module is engaged by a trigger mechanism external to the block.

7. The toy building block of claim 6, wherein the external trigger mechanism comprises another toy building block's unlatched hammer.

8. The toy building block of claim 6, wherein the external trigger mechanism comprises a trigger system configured to engage the release module that is controlled by a user interface.

9. The toy building block of claim 8, wherein the trigger system comprises one of a master block, wireless signals, pneumatics, hydraulics, light detectors, radio frequency, magnetic, switch, pull string, wire cable, button, capacitor sensor, sensors, sound, or various combinations thereon.

10. The toy building block of claim 1, wherein the toy building block is shaped as one of a rectangle, square, triangular, rounded, curved, odd shaped, unsymmetrical about a center axis, symmetrical about a center axis, spherical, conical, hexigonical, or custom shaped for a particular predetermined structure purpose.

11. The toy building block of claim 1, wherein the toy building block is sized between ½ an inch to 2 feet in diameter and between ½ an inch to 2 feet in height.

12. The toy building block of claim 1, wherein the tension module provides between 0.4-1.5 Newtons/mm of force.

13. The toy building block of claim 1, wherein the tension module comprises one of a spring or magnet.

14. The toy building block of claim 1, further comprising a block stabilizer configured to friction couple to the second toy building block.

15. A toy building block with chain reaction trigger, comprising:

a body comprising a chamber module, a tension module housed in the chamber module, the tension module comprising a spring plate, the chamber module configured to receive a second toy building block's hammer module, a hammer module housed in the chamber module and configured to be movable upon an axis of the chamber module, the hammer module configured to trigger the second toy building block, the hammer module movably-attached to a hammer trigger latch, the hammer trigger latch comprising a female recess, a latching module housed in the chamber module, the latching module configured to hold the hammer module under tension, the latching module comprising a trigger plate comprising a male tab, the male tab and the female recess are configured to mate to latch the hammer module under tension; and a releasing module, the releasing module configured to release the hammer module, the male tab and the female recess are configured to un-mate to release the hammer module; and a triggering system.

16. The toy building block of claim 15, wherein the toy building blocks are configured as one of a 2×2, 4×4, 1×2, 1×3, or 1×4 block unit.

17. The toy building block of claim 15, wherein the triggering system comprises one of a master block, wireless signals, pneumatics, hydraulics, light detectors, radio frequency, magnetic, switch, pull string, wire cable, button, capacitor sensor, sensors, sound, or various combinations thereon.

18. A toy building block with chain reaction trigger, comprising:

a body comprising a chamber module;

a tension module housed in the chamber module, the chamber module configured to receive a second toy building block's hammer module;

a hammer module housed in the chamber module and configured to be movable upon an axis of the chamber module, the hammer module configured to trigger the second toy building block;

a latching module housed in the chamber module, the latching module configured to hold the hammer module under tension, the hammer module comprises at least one clip, the clip comprising a flexible spring biased arm comprising a female recess, the chamber module comprising at least one male tab, the female recess configured to mate to the at least one male tab in order to latch the hammer module under tension; and a releasing module, the releasing module configured to release the hammer module.

19. The toy building block of claim 18, further comprising a trigger system; and the trigger system comprises one of a master block, wireless signals, pneumatics, hydraulics, light detectors, radio frequency, magnetic, switch, pull string, wire cable, button, capacitor sensor, sensors, sound, or various combinations thereon.

20. The toy building block of claim 18, wherein the toy building block is shaped as one of a rectangle, square, triangular, rounded, curved, odd shaped, unsymmetrical about a center axis, symmetrical about a center axis, spherical, conical, hexigonical, or custom shaped for a particular predetermined structure purpose.

* * * * *